United States Patent [19]

Ferree

[11] Patent Number: 4,727,745

[45] Date of Patent: Mar. 1, 1988

[54] COMPOSITE DENT BALL

[75] Inventor: Clifford M. Ferree, Tampa, Fla.

[73] Assignee: Sunbeam Plastics Corporation, Evansville, Ind.

[21] Appl. No.: 97

[22] Filed: Jan. 2, 1987

[51] Int. Cl.[4] ..... B21D 1/08

[52] U.S. Cl. ..... 72/478; 72/75; 72/479

[58] Field of Search ..... 72/75, 466, 478, 479, 72/483, 429; 29/130, 127

[56] References Cited

U.S. PATENT DOCUMENTS

| | | | |
|---|---|---|---|
| 2,345,443 | 3/1944 | Aiken | 72/466 |
| 3,422,659 | 1/1969 | Warrick | 72/466 |
| 4,057,992 | 11/1977 | Willimzik | 72/478 |

FOREIGN PATENT DOCUMENTS

| | | | |
|---|---|---|---|
| 0008484 | 4/1896 | United Kingdom | 72/466 |
| 389862 | 7/1973 | U.S.S.R. | 72/479 |

*Primary Examiner*—Robert L. Spruill
*Assistant Examiner*—David B. Jones
*Attorney, Agent, or Firm*—Irvin L. Groh; Alfred L. Patmore, Jr.

[57] ABSTRACT

A large size barrel-shaped dent ball for removing dents in curved and tapered tubing having a diameter between 2½ and 4½ inches such as a tuba. The ball is constructed with a hardwood core and a steel band about the center portion of its length. An axial steel tube is also inserted in the hardwood core to facilitate use and removal of the ball from the tube. This composite structure reduces the overall weight so that the ball can be manipulated during use. A cable tool on which the dent ball can be strung between two metal impact balls is also presented. Reciprocation of the cable provides repeated impact of a metal impact ball against the barrel-shaped dent ball to drive the dent ball under and past the dent in a dent removal and tool retrieval direction.

10 Claims, 4 Drawing Figures

COMPOSITE DENT BALL

This invention relates to a dent ball for removing dents from curved and tapered tubing, and, more particularly, to a large dent ball for removing dents in the curved and tapered tubing of large musical instruments such as a tuba.

A known method of removing dents in curved musical instrument tubing is by forcing a metal dent ball of a spherical or barrel-shape through the tube. To accomplish this, the dent ball is inserted in the tubing first, and then a smaller metal ball is inserted and the instrument is shaken so that the smaller metal ball impacts against the dent ball to drive it under and through the dent area in the dent removing process.

A greatly improved dent removing technique and new tool is set forth in my co-pending patent application, Ser. No. 931,523 filed 11-17-86 which is suitable for removing dents in the curved brass tubing of smaller musical instruments such as trombones, trumpets and french horns. The tool described in this application is designed not only to drive a barrel-shaped metal dent ball past the dent to raise it, but also to reverse the procedure to remove the tool from the horn in working with tubing that is not open-ended. The tool has a series of barrel-shaped force transmitting beads which are pivotally connected to each other and to a tubular handle at one end. At the other end, a length of cable extends through a fixed metal driver ball to a metal retainer bead at the end of the cable. A barrel-shaped dent ball is strung on the cable for movement between the driver ball and the retainer bead for impacting motion by reciprocation of the handle when the dent ball has been lodged underneath the dent to be removed.

While the aforementioned tool is suitable for use in instrument tubing up to a diameter of 2½ inches, it is not practical with larger size tubing or with the curved and tapered tubing of a tuba in which a straight handle tool cannot be used to provide the impact force.

It has been heretofore considered impractical from a cost and handling standpoint to form a barrel-shaped steel dent ball in sizes larger than 2½ inches.

It is, therefore, a primary objective of this invention to construct a lightweight barrel-shaped dent ball which is effective for removing dents in a curved and tapered tubing in the 2½ to 4½ inch range.

It is another objective of this invention to provide a tool for manipulation of this new and improved dent ball in the large curved and tapered tubing of a musical instrument such as a tuba.

The foregoing objectives and other advantages of this new dent ball and tool will become apparent from a description of the dent ball which is constructed as a barrel-shaped composite dent ball. A hardwood core material with a steel band circumscribing the central portion of the length of the ball is formed with an exterior profile of the ball being a continuous barrel-shape embracing the central steel band with wood on both sides. The width of the steel band is approximately ⅓ of the overall length of the ball and its length is approximately equal to its diameter.

The barrel-shaped dent ball is formed by turning a groove in the center of the block of wood to accommodate the inside diameter of the steel band. The block is split into two pieces to assemble the band to the wood. The two pieces are reassembled as by gluing and the composite ball is finished to a continuous barrel-shaped exterior profile. The barrel-shape can be obtained utilizing a radius of between 4 and 5 inches.

A hole is drilled along the axis of the ball and a metal tube is inserted therein running the length of the ball.

A dent removal tool that employs this new barrel-shaped dent ball is constructed with a steel stroke cable, longer than the length of the dent ball, extending through the metal tube of the dent ball with a metal impact ball attached to each end of the stroke cable. A working cable is attached to each of the impact balls so that the tool can be inserted in the curved tube to be repaired and the dent ball wedged under the dent in the tube. One of the impact balls can be repeatedly impacted against the dent ball by the reciprocation of one of the working cables until the ball is driven past the dent. Thereafter the tool can be removed by impacting the other of the impact balls against the dent ball by reciprocation of the other of the working cables.

Adjustable clamping handles are slid over the ends of the working cables so that they may be locked to the cable at a fixed location to facilitate the manual reciprocation of the working cable in both the dent removal direction and the tool removal direction. The stroke cable and the working cables are removably attached to the impact balls so that the cable may be threaded through the tapered tubing of the musical instrument by threading from a small diameter open end to the large diameter horn of the instrument. When the inserted end of the cable appears through the horn of the instrument, the tool can be reassembled and used in the aforementioned manner. Successively larger dent balls may be replaced on the stroke cable to provide a series of dent removal steps in repairing the instrument.

The objects of this invention are accomplished by the embodiment disclosed in the following description and illustrated in the drawing in which.

Figure 1:
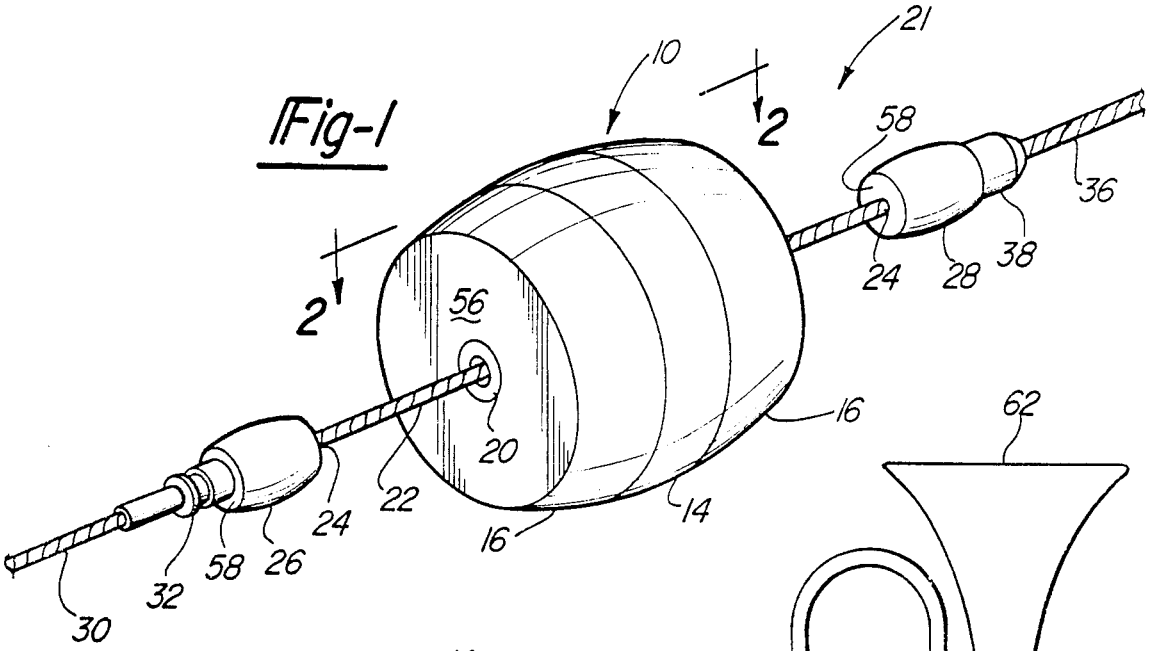
FIG. 1 is a perspective view of the composite barrel-shaped dent ball of this invention shown in working relationship to the elements of the tool of this invention.
Figure 2:
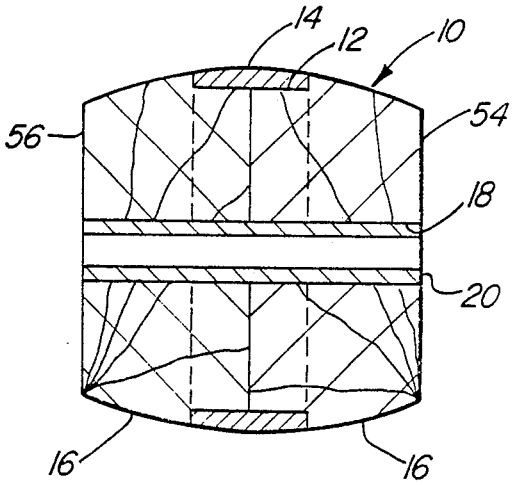
FIG. 2 is an elevational view in section showing the construction of the barrel-shaped dent ball of this invention.

The composite wood-steel dent ball 10 is constructed utilizing a hardwood block. Maple and oak, for example, are suitable for this use. Groove 12 is first turned in the center of the block to a diameter which will accommodate the inside diameter of metal strap member 14 which is suitably made from steel tubing. The block of wood is then sawed in two so that the steel band 14 can be inserted over the reduced diameter of groove 12. In reassembly, a glue such as an epoxy resin is used to cement the two halves 16 of the wood block together with the steel band 14. The width of groove 12 and hence the width of metal strap 14 is made equal to approximately ⅓ of the overall length of the dent ball so that exposed profiles of wood sections 16 will also be ⅓ of the overall length of the ball. The overall length of the ball is made approximately equal to the maximum diameter of the ball. For example, a 3 inch barrel-shaped dent ball will have a maximum diameter of 3 inches with the width of metal strap 14 and exposed wood surfaces 16 being each 1 inch. The barrel-shaped contour or exterior profile is turned in the composite wood and steel stock. For a range diameter between 2½ and 4½ inches, a suitable continuous barrel-shaped can be turned utilizing a radius of 4½ to 5 inches.

A hole 18 is drilled along the axis of the dent ball 10 and a steel tube 20 is inserted and glued in position so that it extends the length of the ball. The tube will have a size of approximately ½ inch outside diameter and a ¼ inch inside diameter. Variations in the manufacturing process could include the use of two separate pieces of wood and tube 20 could be assembled before the turning of the exterior barrel-shaped profile.

The tool 21 for utilizing the dent ball is constructed wtih a steel stroke cable 22 having threaded ferrules swaged onto each of its ends 24. Steel impact balls 26 and 28, which are generally barrel-shaped and threaded at both ends, are screwed onto each threaded end 24 of the stroke cable 22. Working cable 30 having a permanently attached ferrule 32 with a threaded end is screwed into impact ball 26, and working cable 36 having a rotatable ferrule 38 with a threaded end is screwed into impact ball 28. Also threaded on working cables 30 and 36 are finger grip locking handles 42 and 44 respectively. Each of these handles have a wedging lock lever 46 pivoted at 48 so that the user can position the handle at a convenient point on the working cable being used and lock it in position during use by squeezing the lever 46 towards the handle.

Figure 4:
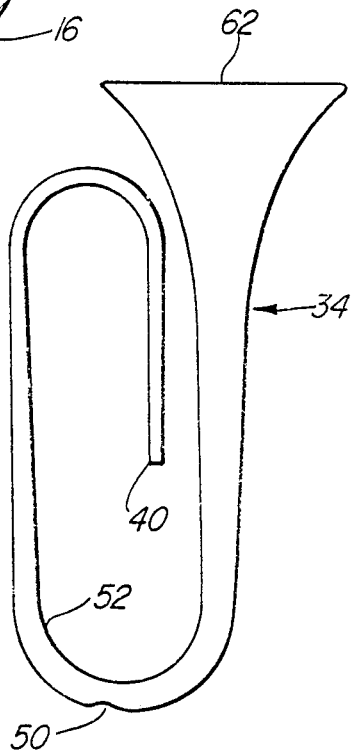
FIG. 4 is a plan of a portion of a musical instrument, a tuba, in which the composite dent ball and tool of this invention can be used to remove dents therefrom.
Figure 3:
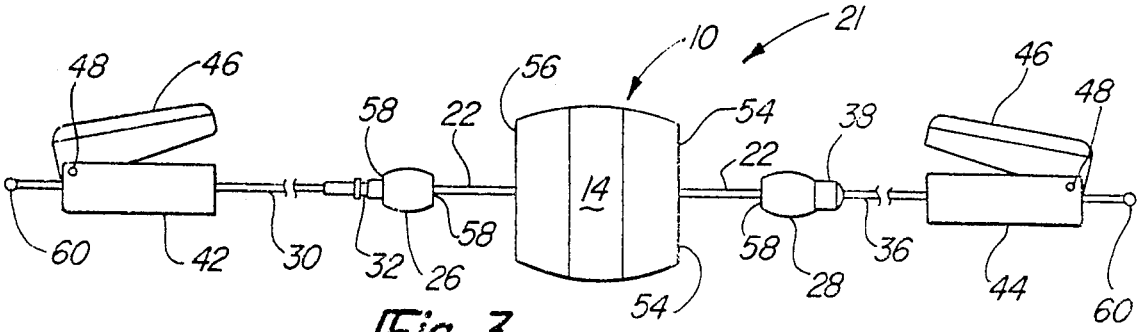
FIG. 3 is an overall view of the tool showing the adjustable handles and their relationship to the working cables.

In use, the impact balls 26 and 28 and the stroke cable 22 would be unthreaded from the working cables 30 and 36 so that the working cable 30 alone with its fixed ferrule 32 would be threaded through a musical instrument 34, a portion of which is shown in FIG. 4, to be repaired from a small diameter open end 40 of the instrument through the curved tubing 52 and out the large bell end 62 of the instrument. The tool can then be reassembled using a dent ball of a diameter which is slightly larger than the dent 50 to be removed from the instrument tube 52. In assembling the tool, impact ball 26 would be first threaded onto working cable 30 holding the cable stationary and rotating the impact ball 26. Next, the stroke cable would be threaded into the other end of impact ball 26, and the selected dent ball 10 would be threaded or strung over the stroke cable 22. Impact ball 28 would then be threaded onto the other end of stroke cable 22, and the working cable 36 would be screwed into the thrust ball 28 by holding the ball 28 stationary and rotating the rotatable threaded ferrule 38. The use of a rotating ferrule 38 at this end of the tool simplifies the threading procedure avoiding twisting and tangling the long working cable length.

Handle 42 can then be positioned at a convenient point on working cable 30 and grasped for pulling the cable back through the small end of the tubing until the dent ball 10 becomes lodged under the dent to be removed. As the handle 42 is pulled, the impact ball 28 is pulled against the dent ball 10 to positively drive it through the tubing. When the dent ball 10 is lodged under the dent 50 to be raised or eliminated, cable 30 can be reciprocated by a movement of handle 42 so that the impact ball 28 repeatedly impacts against the flat end 54 of barrel-shaped dent ball 10. When the dent ball 10 has been driven past the dent 50, it has accomplished all of the raising possible with this size dent ball and it is removed. Removal is accomplished by the reciprocation of handle 44 and working cable 36 which drives the impact ball 26 against the other flat face 56 of the dent ball 10. When the dent ball is free, the disassembly and assembly procedure can be repeated to put the next larger size dent ball on the stroke cable to repeat the raising procedure. In diameter range between 2½ and 4½ inches, these dent balls would be supplied in sets having an incremental increase in size of 1/64 inch.

Both of the impact balls 26 and 28 are preferably of steel and have a generally barrel-shape with flat end faces 58 which allows the threaded ferrules 32 and 38 to be threaded into abutting relationship, and one of the flat impact faces 58 of impact balls 26 and 28 will impact the flat faces 54 and 56 of the dent ball 10. Different size impact balls may be employed for different size of dent balls being used. For example, various sizes may be used ranging from ¾ inch in diameter through 1½ inch diameter for the 2½ to 4¼ inch diameter range of dent balls. Also different lengths of stroke cable can be used to provide a length approximately twice the length of the dent ball for an adequate impacting stroke. Handles 42 and 44 can be restrained on their respective working cables 30 and 36 by the use of stop balls 60 which may be swaged or soldered to the ends of the cables. While the dent ball 10 would be used in most instances with the cable tool 21, it is clear that it can be utilized without such a tool utilizing only the dent ball itself and a impact ball in a shaking impact manner. Even with the very substantial reduction in weight created by the composite wood-steel structure, it is usually more practical to work with the cable tool as described.

The embodiments of the invention in which an exclusive property or priviledge is claimed are defined as follows:

1. A 2½ inch to 4½ inch diameter composite barrel-shaped dent ball for removing dents from curved tubing comprising:

a hard wood core with a centrally located external groove extending approximately one-third of the overall length of the ball;

a steel band seated within the core groove circumscribing the central portion of the length of said ball core, the exterior profile of said ball being a continuous barrel shape embracing the central steel band wtih wood on both sides thereof.

2. The barrel-shaped dent ball of claim 1 wherein the length of said ball is approximately equal to its diameter.

3. The barrel-shaped dent ball of claim 1 wherein the exterior profile of said ball is a radius of between 4 inches and 5 inches.

4. A 2½ inch to 4½ inch diameter composite barrel-shaped dent ball for removing dents from curved tubing comprising:

a hardwood core material with a steel band circumscribing the central portion of the length of the ball, the exterior profile of said ball being a continuous barrel shape embracing the central steel band with wood on both sides thereof; and a metal tube located at the axis of said barrel-shape dent ball extending the length of said ball.

5. The barrel-shaped dent ball of claim 4 wherein said metal tube is steel.

6. A dent removal tool employing the barrel-shaped dent ball of claim 4 and further including:

a steel stroke cable, longer than the length of said dent ball, extending through said metal tube; a metal impact ball attached to each end of said stroke cable; and a working cable attached to each impact ball; whereby the tool may be inserted into a curved tube and the dent ball wedged under a dent in the tube, and one of said impact balls can be repeatedly impacted against said dent ball by reciprocation of one of said working cables until the dent ball is driven past the dent whereupon the tool may be removed by impacting the other of said impact balls against said dent ball by reciprocation of the other of said working cables.

7. The dent removal tool of claim 6 further comprising:

a handle slid over said each of said working cables, each of said handles having a lock for engaging the working cable at a fixed location to facilitate the manual reciprocation of the working cable in a dent removal direction or in a tool removing direction.

8. The dent removal tool of claim 7 wherein the stroke cable is removably attached to each of said impact balls.

9. The dent removal tool of claim 8 wherein each of said working cables is removably attached to a respective one of said impact balls.

10. A $2\frac{1}{2}$ inch to $4\frac{1}{2}$ inch diameter composite barrel-shaped dent ball for removing dents from curved tubing comprising:

a hardwood core material having an exterior barrel shape and a length equal to approximately the maximum diameter of the ball;

an exterior groove at the center of the length of said ball extending approximately $\frac{1}{3}$ the length thereof;

steel band fitted in said groove and having a exterior surface which is continuous with the barrel-shaped exterior surface of the ball; and a central steel tube located at the axis of said ball and extending the length thereof.

* * * * *